United States Patent [19]

Angshed

[11] 4,173,344

[45] Nov. 6, 1979

[54] GOLF SWING TRAINING DEVICE AND METHOD

[76] Inventor: Torsten A. Angshed, 2221 W. 120th Pl., Blue Island, Ill. 60406

[21] Appl. No.: 908,940

[22] Filed: May 24, 1978

[51] Int. Cl.[2] ..... A63B 69/36

[52] U.S. Cl. ..... 273/183 B; 273/189 R

[58] Field of Search ..... 273/191 B, 189 R, 191 A, 273/188 R, 183 B, 191 R, 189 A; 35/29 A

[56] References Cited

U.S. PATENT DOCUMENTS

| | | | |
|---|---|---|---|
| 3,188,090 | 6/1965 | Job | 273/189 R |
| 3,804,420 | 4/1974 | Boyd | 273/191 B |
| 3,917,281 | 11/1975 | Oppenheimer | 273/191 B |
| 4,034,991 | 7/1977 | Oppenheimer | 273/191 B X |

*Primary Examiner*—George J. Marlo

*Attorney, Agent, or Firm*—Tilton, Fallon, Lungmus & Chestnut

[57] ABSTRACT

A device and method for helping a golfer to execute a correct golf swing and to establish or "groove" that swing. The device comprises an arcuate guide member which is dimensioned and supported to extend along the path of travel of a golfer's hands throughout the execution of a full and correct golf swing. The arcuate guide member includes a channel which slidably retains a rider, the rider being detachably connected by a strap to a glove worn by the golfer and gliding along the channel as the swing takes place. Should the golfer's hands tend to leave the plane of the correct swing, or should an undesirable twisting action of the hands and/or wrists occur, the strap will become taut and exert a correcting force.

10 Claims, 5 Drawing Figures

GOLF SWING TRAINING DEVICE AND METHOD

BACKGROUND AND SUMMARY

Over the years, a number of teaching devices have appeared in the patent literature, although seldom marketed, for guiding a golf club during the performance of a golf swing. U.S. Pat. Nos. 1,670,409 and 3,794,329 depict devices which provide tracks for guiding the heads or blades of golf clubs. U.S. Pat. Nos. 2,520,287, 1,567,530, 3,489,416, and 3,711,103 show similar devices which guide the shafts of clubs.

One aspect of this invention lies in the discovery that all such devices are misdirected and ineffective to the extent that they directly guide a club as it is swung and necessarily impose a restraint on club movement. Even the slightest resistance to such movement interferes with proper execution of a swing and is therefore self-defeating in its effect. Guiding movement of the clubhead or shaft may illustrate to the golfer the correct path of club movement but the contact between the guide channel and the club adversely affects freedom of movement and retards clubhead acceleration required in the execution of a proper swing.

Another aspect of this invention lies in the further discovery that effective control over the direction of club movement in the operation of a golf swing training device may be achieved without contacting any part of the club itself but may instead be accomplished by directing the plane and path of movement of the golfer's hands. Such guidance does not interfere with the uncocking of the wrists as the clubhead accelerates through the zone of impact; hence, through the hands the club is indirectly guided along the proper path without at the same time restraining the natural wrist action which generates clubhead speed in a well-executed golf swing.

The device of the invention consists essentially of an arcuate guide member having the outline of the path of movement of a golfer's hands in the execution of a proper golf swing. The guide member is C-shaped in cross sectional configuration and defines a channel along which a rider is freely movable. A suitable platform supports the guide member along an inclined plane which is generally parallel with the plane of movement of a golfer's hands in the execution of a golf swing. A strap is secured at one end to the rider and is connected at its opposite end to the golfer's hands, preferably to a glove worn by the golfer's dominant hand. Thus, a golfer who swings right-handed clubs would wear such a glove on his right hand, the strap preferably being detachably connected to such a glove in the zone of convergence of the index finger and thumb.

In the best mode presently known for practicing the invention, the connection between the strap and glove is releasable. Such a releasable connection not only simplifies use of the device, since it permits the glove to be fitted or removed without the encumbrance from the attachment strap, but also acts as a safety release in the event that the golfer's swing departs so radically from the optimum swing that restraint by the strap and associated equipment might possibly cause injury.

Other objects and advantages of the invention will become apparent from the specification and drawings.

DRAWINGS

DETAILED DESCRIPTION

Figure 1:
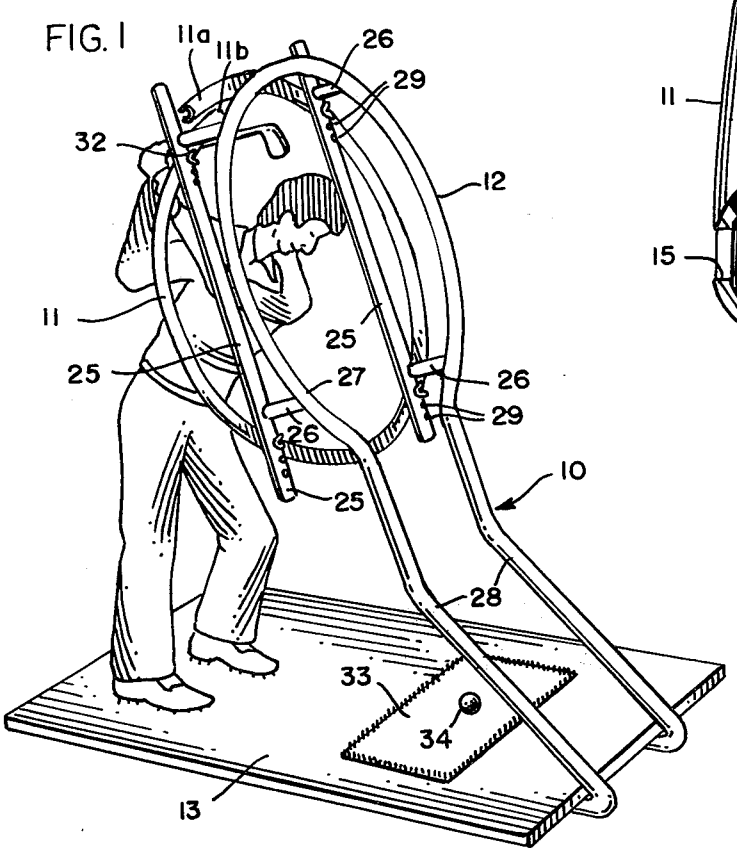
FIG. 1 is a perspective view of a golf swing training device embodying the invention, such device being depicted in use.

Referring to FIG. 1, the numeral 10 generally designates a golf swing training device comprising an arcuate guide member 11, a supporting frame 12, and a platform 13. The guide member has the outline of the path of movement of a golfer's hands in a properly-executed golf swing. As shown, the member describes an ark slightly in excess of 360 degrees with end portions 11*a* and 11*b* being disposed in spaced overlapping relation. The guide member 11 extends substantially along a single plane with a slight departure occurring in the zone where end portions 11*a* and 11*b* overlap.

Figure 2:
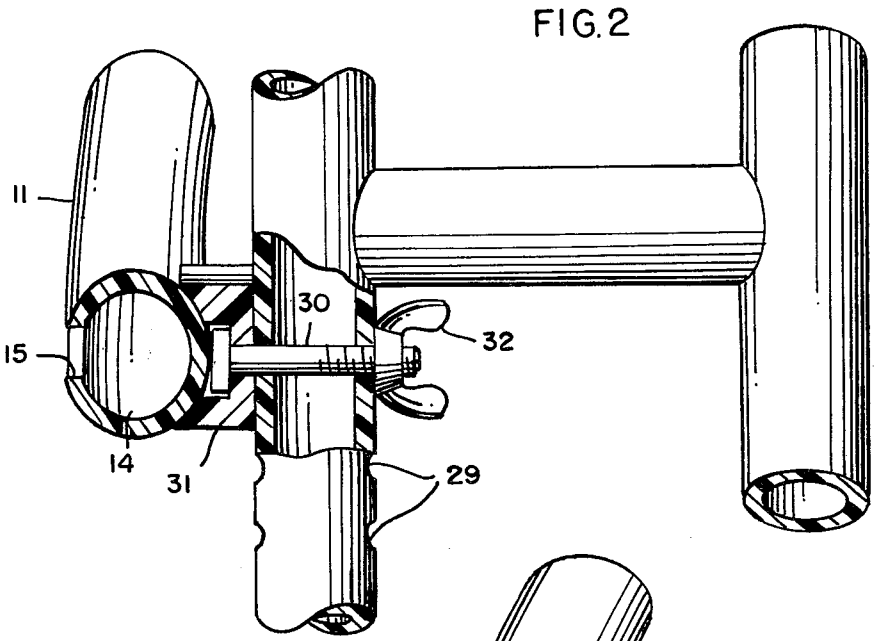
FIG. 2 is an enlarged sectional view of coupled components shown in FIG. 1.
Figure 3:
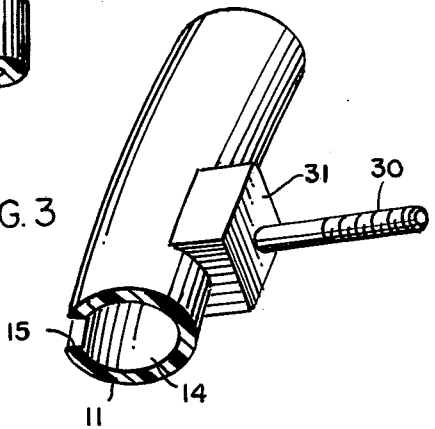
FIG. 3 is a perspective view of a section of the guide member illustrating details of the coupling means therefor.
Figure 4:
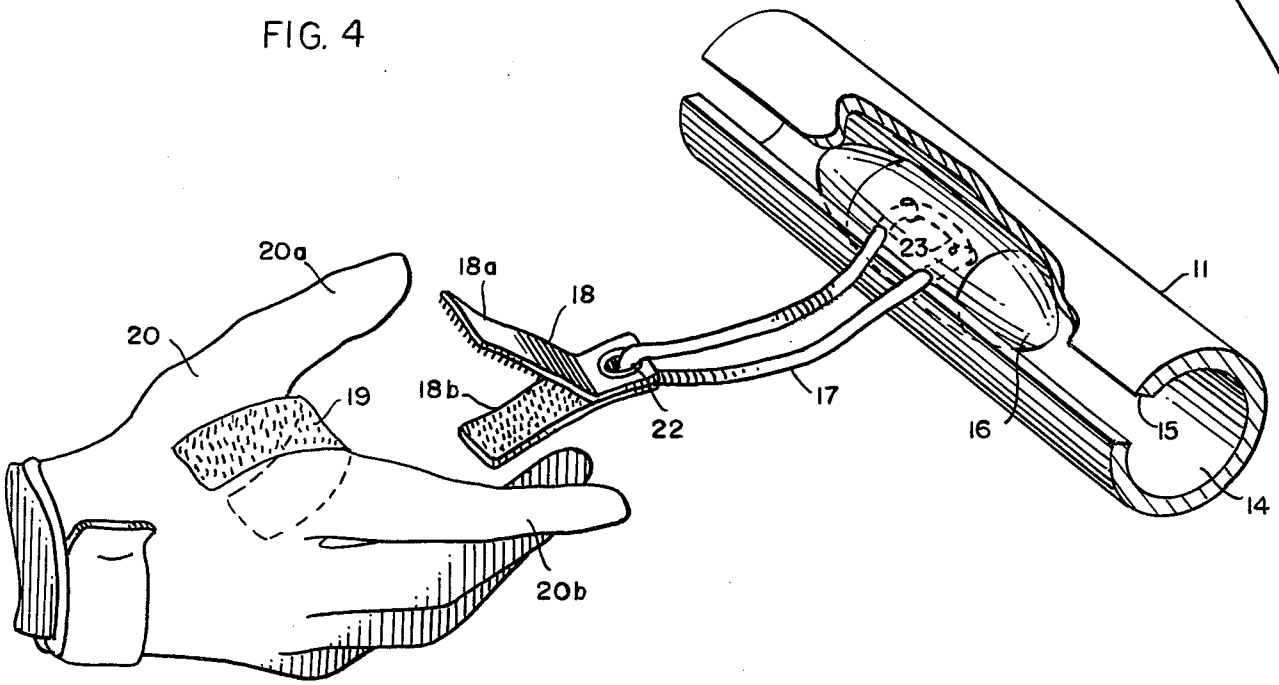
FIG. 4 illustrates the relationship between the guide channel, a rider and its connecting strap, and a glove worn by the golfer.

As shown most clearly in FIGS. 2–4, the guide member 11 is C-shaped in cross sectional configuration, defining a generally cylindrical channel 14 and a longitudinal slit or opening 15. A rider 16, having a cylindrical body with rounded ends, is slidably disposed within the channel. A flexible strap 17 is joined at one end to the rider and at its other end to a connector 18, the latter being adapted for connection to the hands of a golfer using the golf swing training device. In the illustration given, the connector 18 of the strap is bifurcated, having a pair of panels 18*a* and 18*b* which are capable of detachably engaging band 19 of golf glove 20. Particularly effective results have been achieved by using the product marketed under the Velcro trademark with band 19 and panels 18*a* and 18*b* being provided with a multiplicity of plastic hooks and loops which are capable of secure but detachable interengagement; however, it is to be understood that other types of releasable connecting means may be provided.

Figure 5:
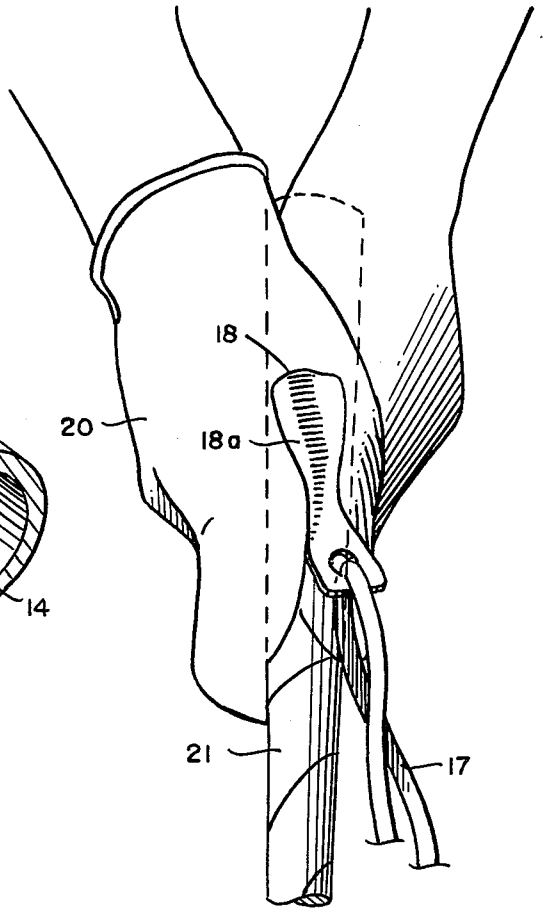
FIG. 5 shows the positions of the golfer's hands in relation to the connecting strap when a club is held in a ball-addressing position by the golfer.

Connector 18 of the strap connects with band 19 of the glove along the convergence of the thumb and index finger portions 20*a* and 20*b*. Unlike the usual golf glove, glove 20 is worn on the golfer's dominant hand; that is, a right handed golfer would wear glove 20 on his right hand as shown in FIGS. 4 and 5. The result is that strap 17 connects to the dominant hand along an exposed area in close proximity to the shaft 21 of a golf club when the club is held in the manner depicted in FIG. 5.

The length of strap 17—that is, the distance between the band portion 19 of the glove and rider 16—should fall within the range of approximately 3 to 10 inches. Most effective results have been achieved with straps of approximately 5 to 6 inches in length. In the construction illustrated in FIGS. 4 and 5, strap 17 is shown in the form of a continuous loop passing through eyelet 22 of the connector and U-shaped opening 23 of the rider. It is to be understood, however, that strap 17 may take the form of only a single strand or, alternatively, may have three or more strands. The essential requirements are that the strap be highly flexible, capable of twisting, and have a length within the ranges specified.

Since the arcuate guide channel 11 has an outline which should closely approximate the path of movement of a golfer's hands during a properly executed golf swing, it is believed apparent that the length and radius of the arc will depend on the size of the golfer. The device is therefore constructed so that guide channels 11 of different size may be mounted upon frame 12. As shown in FIG. 1, the frame includes a pair of spaced mounting members 25 secured to struts 26, the struts in turn being joined to loop-shaped support member 27. The lower ends of the loop merge with legs 28 which connect with platform 13. The spaced mounting members 25 extend along an inclined plane which is generally parallel with the intended plane of the golfer's swing. A plurality of openings 29 are formed in the mounting members to receive the mounting screws 30 of different size guide channel members 11. Screws 30 are carried by mounting blocks 31 affixed to the guide member 11 at a plurality of points (four) therealong and extend through selected openings in the mounting members 25 as shown most clearly in FIGS. 2 and 3. Wing nuts 32 may be used to secure the channel member 11 of selected size to the inclined mounting members 25 of the support frame.

Platform 13 provides a support for the golfer as well as a base for the remainder of the golf swing guiding device. A patch of artificial turf 33 is preferably secured to the platform for the purpose of supporting golf ball 34. It is to be understood that where the ball is to be supported by a tee, the panel of artificial turf may be eliminated and, if desired, a different type of material (e.g., a rubber or plastic mat) may be substituted.

In the use of the device, a golfer stands upon platform 13 and, with glove 20 connected by strap 17 to the rider within guide channel 11, executes a golf swing as depicted in FIG. 1. If the swing is defective for any of a variety of reasons (e.g., excessive flatness, poor extension, lateral movement, excessive pronation or wrist action, poor follow through, etc.), the guide member 11 and strap 17 will exert a guiding force on the golfer's hands to help correct the defect without, at the same time, directly interfering with club movement. The golfer is therefore able to generate the timing and rhythm of a proper swing even though some guiding force may be exerted upon his hands during execution of that swing. Should for any reason the magnitude of that force exceed the strength of the attachment between strap connector 18 and glove 20, the strap will automatically disengage from the glove to prevent possible injury to the golfer or damage to the equipment.

While in the foregoing I have disclosed an embodiment of the invention in considerable detail for purposes of illustration, it will be understood by those skilled in the art that many of these details may be varied without departing from the spirit and scope of the invention.

I claim:

1. A golf swing training device comprising an arcuate guide member having the outline of the predetermined path of movement of a golfer's hands in the execution of a prescribed golf swing, means supporting said guide member along an inclined plane parallel with the path of movement of a golfer's hands during such a swing, said arcuate guide member defining a channel therealong, a rider freely movable along said channel but being restrained against lateral release therefrom, means adapted to be worn upon at least one of a golfer's hands, and strap means secured at one end to said rider and being connected at the opposite end thereof to said means adapted to be worn upon at least one of the golfer's hands for guiding movement of the golfer's hands in the execution of said golf swing.

2. A golf swing training device comprising an arcuate guide member having the outline of the predetermined path of movement of a golfer's hands in the execution of a prescribed golf swing, means supporting said guide member along an inclined plane parallel with the path of movement of a golfer's hands during such a swing, said arcuate guide member defining a channel therealong, a rider freely movable along the channel but being restrained against lateral release therefrom, a glove, and strap means secured at one end to said rider and being detachably secured at its opposite end to said glove for guiding movement of the hands in the execution of said golf swing.

3. The device of claim 2 in which said glove is a right-handed glove for a right-handed golfer and a left-handed glove for a left-handed golfer, and said opposite end of said strap detachably connects to said glove adjacent the convergence of the index finger and the thumb receiving portions of said glove.

4. The device of claim 3 in which said strap includes a bifurcated connector at said opposite ends, said connector defining a pair of terminal portions, said terminal portions and said glove being provided with engagable and releasable hook-loop panels for detachably coupling said strap to said glove.

5. The device of claim 2 in which said strap is of a length within the range of approximately 3 to 10 inches.

6. The device of claim 5 in which said strap is of a length within the range of approximately 5 to 6 inches.

7. The device of claim 2 in which said guide member is generally C-shaped in cross section and said rider is generally cylindrical in configuration with rounded ends.

8. A method for training a golfer in the execution of a golf swing, comprising the steps of connecting at least one of the golfer's hands to one end of a strap by means of a glove attached to said one end of said strap, the opposite end of the strap being attached to a rider, and thereafter guiding the rider along an arcuate path extending along and parallel with the preferred path of movement of the golfer's hands in the execution of the prescribed swing.

9. The method of claim 8 in which said glove is worn on the golfer's dominant hand.

10. The method of claim 9 in which the strap is connected to the glove worn on the golfer's dominant hand in the zone of convergence of the thumb and index finger.

* * * * *